US006473934B2

(12) United States Patent
Lijzenga

(10) Patent No.: US 6,473,934 B2
(45) Date of Patent: Nov. 5, 2002

(54) SUCTION ATTACHMENT COMPRISING A ROTATABLE FOOT AND A DISPLACEABLE BRUSH

(75) Inventor: Henk Lijzenga, Hoogeveen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/850,345

(22) Filed: May 7, 2001

(65) Prior Publication Data

US 2002/0017006 A1 Feb. 14, 2002

(30) Foreign Application Priority Data

May 11, 2000 (EP) ..... 00201687

(51) Int. Cl.[7] ..... A47L 9/06
(52) U.S. Cl. ..... 15/373; 15/411
(58) Field of Search ..... 15/355, 373, 368, 15/411

(56) References Cited

U.S. PATENT DOCUMENTS

| | | | | | |
|---|---|---|---|---|---|
| 1,318,881 | A | * | 10/1919 | Kelley | 15/354 |
| 2,620,506 | A | * | 12/1952 | Weiland | 15/325 |
| 2,842,792 | A | * | 7/1958 | Coons | 15/355 |
| 2,961,689 | A | * | 11/1960 | Meyerhoefer | 15/371 |
| 3,013,294 | A | * | 12/1961 | Ostrom | 15/373 |
| 3,040,367 | A | * | 6/1962 | Hellstrom | 15/371 |
| 3,750,222 | A | * | 8/1973 | Johnson | 15/411 |

FOREIGN PATENT DOCUMENTS

FR 2796260 A1 1/2001

* cited by examiner

*Primary Examiner*—Chris K. Moore
(74) *Attorney, Agent, or Firm*—Ernestine C. Bartlett

(57) ABSTRACT

A suction attachment for a vacuum cleaner. The suction attachment comprises a foot, a suction opening extending in an imaginary plane, and a connection member for connecting the foot to a suction channel of the vacuum cleaner. The foot is provided with a brush, which is displaceable by means of an adjusting device from a first position, in which the brush is recessed in the suction opening, to a second position, in which the brush protrudes from the suction opening. The foot is rotatable with respect to the connection member about an axis of rotation, which extends substantially perpendicularly to the imaginary plane, from a first position to at least a second position, and the adjusting device includes a coupling member by means of which the brush is coupled to the connection member, the coupling member holding the brush in its first position, in the first position of the foot, and the coupling member holding the brush in its second position, in the second position of the foot. In this manner, the brush can be displaced in the foot in a light and convenient manner by simply rotating the foot about the axis of rotation. In a preferred embodiment, the foot is symmetrical in shape and can be rotated from a first position, in which the foot extends perpendicularly to a displacement direction X of the foot and the brush is in its first position, to a second position, in which the foot is rotated through 180° with respect to the first position and the brush is in its second position, and to a third position and a fourth position, in which the foot is rotated through 90° and 270°, respectively, with respect to the first position, and the brush is in its second and first position, respectively. In the third and the fourth position of the foot, the suction attachement has a comparatively small width and is suitable for cleaning narrow spaces or corners.

8 Claims, 6 Drawing Sheets

SUCTION ATTACHMENT COMPRISING A ROTATABLE FOOT AND A DISPLACEABLE BRUSH

BACKGROUND OF THE INVENTION

The invention relates to a suction attachment for a vacuum cleaner, which suction attachment is provided with a foot, a suction opening extending in an imaginary plane in the foot, which suction opening is bounded by an edge of the foot, and a connection member for connecting the foot to a suction channel of the vacuum cleaner, the foot being provided, near the edge, with a brush, which can be displaced by means of an adjusting device from a first position, wherein the brush is recessed in the suction opening, to a second position, wherein the brush protrudes from said suction opening.

The invention also relates to a vacuum cleaner provided with a housing, wherein an electrical suction unit is accommodated, and with a suction attachment, which can be coupled to the suction unit via a suction channel and is provided with a foot, a suction opening in said foot extending in an imaginary plane and being bounded by an edge of the foot, and a connection member for connecting the foot to the suction channel, the foot being provided, near the edge, with a brush which can be displaced by means of an adjusting device from a first position, wherein the brush is recessed in the suction opening, to a second position wherein the brush protrudes from the suction opening.

A vacuum cleaner and a suction attachment used therein of the types mentioned in the opening paragraphs are commonly known and in general use. In the known suction attachment, the adjusting device for displacing the brush comprises a tumbler knob which is provided on an upper side of the foot and can be operated by a user of the vacuum cleaner by means of, for example, a foot. Said tumbler knob is coupled to a support by means of an adjusting mechanism, which support is displaceably guided in the foot and onto which the brush is secured. By operating the tumbler knob, the user can displace the brush from the first position to the second position and from the second position to the first position. In its first position, the brush is recessed in the suction opening and the suction attachment can suitably be used to clean carpets. In its second position, the brush protrudes from the suction opening and the suction attachment can suitably be used to clean a smooth floor surface.

A drawback of the known vacuum cleaner and the known suction attachment used therein resides in that the tumbler knob is rather heavy to operate as a result of its comparatively small dimensions. As a result, the ease of use of the known vacuum cleaner and the known suction attachment are adversely affected.

SUMMARY OF THE INVENTION

It is an object of the invention to provide a suction attachment and a vacuum cleaner of the types mentioned in the opening paragraphs, which enable the adjusting device for displacing the brush of the suction attachment to be operated with less effort, so that the ease of use of the suction attachment and the vacuum cleaner is improved.

To achieve this object, a suction attachment in accordance with the invention is characterized in that the foot is rotatable with respect to the connection member about an axis of rotation extending substantially perpendicularly to the suction opening, from a first position to at least a second position, and in that the adjusting device comprises a coupling member by means of which the brush is coupled to the connection member, the coupling member holding the brush in its first position when the foot is in the first position, and in its second position when the foot is in the second position.

To achieve this object, a vacuum cleaner in accordance with the invention is characterized in that the suction attachment used therein is a suction attachment in accordance with the invention.

As the brush is coupled to the rotatable foot by means of the coupling member, and the coupling member holds the brush in its first position when the foot is in the first position, and in its second position when the foot is in the second position, the brush of the suction attachment in accordance with the invention can be displaced from its first position to its second position and from its second position to its first position by rotating the foot about said axis of rotation from, respectively, its first position to its second position and from its second position to its first position. As the foot has comparatively large dimensions, the user only has to apply a comparatively small force to the foot in order to exert a torque about the axis of rotation necessary to rotate the foot and displace the brush, so that the operation of the adjusting device is comparatively light and the ease of use of the suction attachment is improved. As said axis of rotation extends substantially perpendicularly to the suction opening, said suction opening substantially remains in said imaginary plane during rotation of the foot. By virtue thereof, it is achieved that, if in the first position of the foot and in a predetermined position of the connection member with respect to a surface to be cleaned, the suction opening extends substantially parallel to said surface, then, in the second position of the foot and in said predetermined position of the connection member, the suction opening also extends substantially parallel to said surface.

A particular embodiment of a suction attachment in accordance with the invention is characterized in that, in its first position, the foot extends substantially perpendicularly to a displacement direction of the foot while, in its second position, the foot is rotated about the axis of rotation through an angle of substancially 180° with respect to its first position. As, in its first position, the foot extends substantially perpendicularly to the displacement direction and, in its second position, said foot is rotated about the axis of rotation through substancially 180° with respect to the first position, the foot extends, in its second position, also substantially perpendicularly to the displacement direction, so that, in its first and second position, the foot is comparably positioned with respect to the surface to be cleaned and, viewed perpendicularly to the displacement direction, has comparable suction ranges.

A further embodiment of a suction attachment in accordance with the invention is characterized in that the foot is provided with a front edge and a rear edge extending transversely to the displacement direction, and, near the front edge and the rear edge, with a separate brush which can be displaced by means of the adjusting device. In this embodiment, the foot is substantially symmetrical with respect to a principal axis extending perpendicularly to the displacement direction. As a result, in its first and second position, the foot takes up substantially equal positions with respect to the surface to be cleaned and the foot has substantially equal suction properties in the first and the second position.

Yet another embodiment of a suction attachment in accordance with the invention is characterized in that the foot can also be rotated about the axis of rotation to a third position, wherein the foot is rotated through an angle of substancially 90° with respect to its first position, and to a fourth position, wherein the foot is rotated through an angle of substancially 270° with respect to its first position, the coupling member holding the brush in its first position when the foot is in the third position, and in its second position when the foot is in the fourth position. In said embodiment, in its first and second position, the foot extends substantially perpendicularly to the displacement direction of the suction attachment, so that the suction attachment has a comparatively wide suction range, viewed perpendicularly to the displacement direction, and, in its third and fourth position, the foot extends substantially parallel to the displacement direction, so that, viewed perpendicularly to the displacement direction, the suction attachment has a comparatively narrow suction range. By virtue thereof, in the first and the second position of the foot, the suction attachment is suitable for normal use, and in the third and the fourth position of the foot, the suction attachment is suitable for use in comparatively narrow spaces or corners. In combination with both the comparatively wide suction range and the comparatively narrow suction range, the suction attachment can be used with and without the protruding brush by rotating the foot from, respectively, its first position to its second position, or conversely, and from its third position to its fourth position, or conversely. By virtue thereof, the suction attachment has a comparatively large number of applications.

A particular embodiment of a suction attachment in accordance with the invention is characterized in that the suction attachment is provided with a lock device by means of which the foot can be locked in at least one of its four positions with respect to the connection member. By using said lock device, it is precluded that the foot is unintentionally rotated from the relevant position under the influence of handling forces exerted during operation. The ease of use of the suction attachment is further improved thereby.

A further embodiment of a suction attachment in accordance with the invention is characterized in that the connection member is provided with a substantially cylindrical portion having a central axis extending substantially perpendicularly to the suction opening, and with a connection channel which can be connected to the suction channel of the vacuum cleaner, the foot being journalled so as to be rotatable about the cylindrical portion, while the connection channel is pivotable, with respect to the cylindrical portion, about a pivot axis extending substancially perpendicularly to the central axis. In this embodiment, the axis of rotation of the foot substantially coincides with the central axis of the cylindrical portion of the connection member. By using the cylindrical portion and the connection channel, a practical and efficient construction of the suction attachment is obtained, wherein the foot is rotatably journalled in an efficient and robust manner, and the connection channel is pivotable in a practical and user-friendly manner.

Yet another embodiment of a suction attachment in accordance with the invention is characterized in that the connection member is provided with a substantially cylindrical portion having a central axis extending substantially perpendicularly to the suction opening, the foot being journalled so as to be rotatable about the cylindrical portion, while the coupling member is provided with a slot, which is provided in an outer wall of the cylindrical portion, a support for the brush, which support is guided in the foot so as to be displaceable guided in the foot in a direction substantially parallel to the central axis, and a slot follower, which is provided on the support and engages in the slot. In this embodiment, the coupling member is embodied in a practical and simple manner, said slot, viewed in the direction of rotation of the foot, having a profile which corresponds to a desired displacement of the support with the brush as a function of the position of the foot.

DETAILED DESCRIPTION OF THE DRAWINGS

Figure 1:
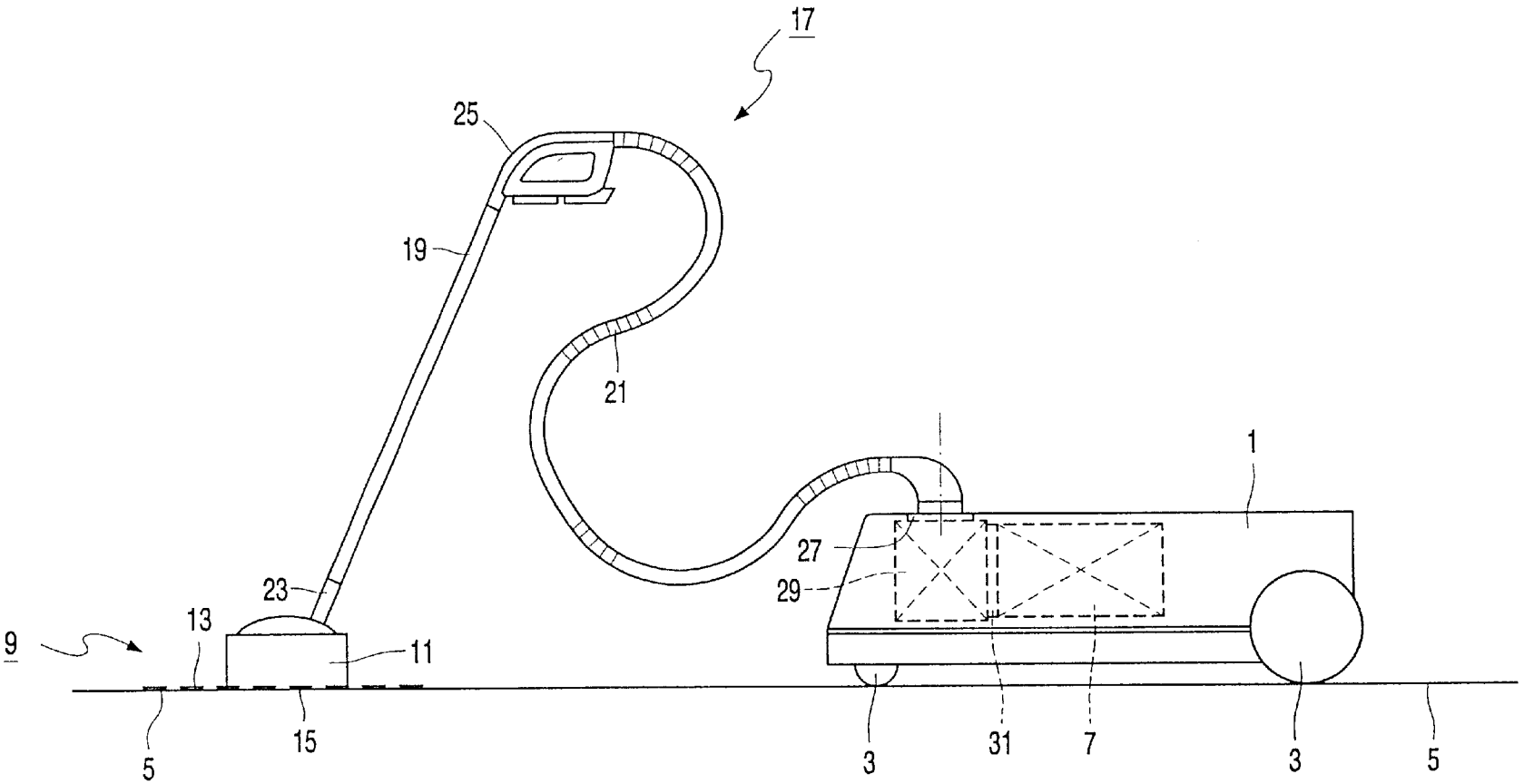
FIG. 1 diagrammatically shows a vacuum cleaner in accordance with the invention.

The invention will now be described in greater detail with reference to the figures of the drawing.

The vacuum cleaner in accordance with the invention, as diagrammatically shown in FIG. 1, is a so-called cylinder vacuum cleaner, which comprises a housing 1 which can be displaced by means of a number of wheels 3 over a surface 5 to be cleaned. The housing 1 accommodates an electrical suction unit 7, which is only diagrammatically shown in FIG. 1. The vacuum cleaner further comprises a suction attachment 9 in accordance with the invention, which is provided with a foot 11 and a suction opening 15 in said foot extending in an imaginary plane 13. In an operating position of the suction attachment 9 on the surface 5 to be cleaned, as shown in FIG. 1, said imaginary plane 13 of the suction opening 15 extends substantially parallel to the surface 5 to be cleaned. The suction attachment 9 is detachably coupled to the housing 1 via a suction channel 17, which comprises a metal suction tube 19 and a flexible suction hose 21, the suction attachment 9 comprising a connection member 23 by means of which the suction attachment 9 is detachably coupled to the suction tube 19, while the suction tube 19 is detachably coupled to a tubular handle 25 attached to the suction hose 21, and the suction hose 21 is detachably coupled to an input 27 of the housing 1. The input 27 opens into a dust chamber 29 of the housing 1, which is connected, via a filter 31, to the suction unit 7. In operation, the suction unit 7 generates, via the dust chamber 29 and the suction channel 17, an underpressure in the suction attachment 9, under the influence of which dust and dirt particles present on the surface 5 to be cleaned are sucked via the suction opening 15 of the suction attachment 9 and via the suction channel 17 to the dust chamber 29 where they are collected in an exchangeable dust bag.

Figure 2:
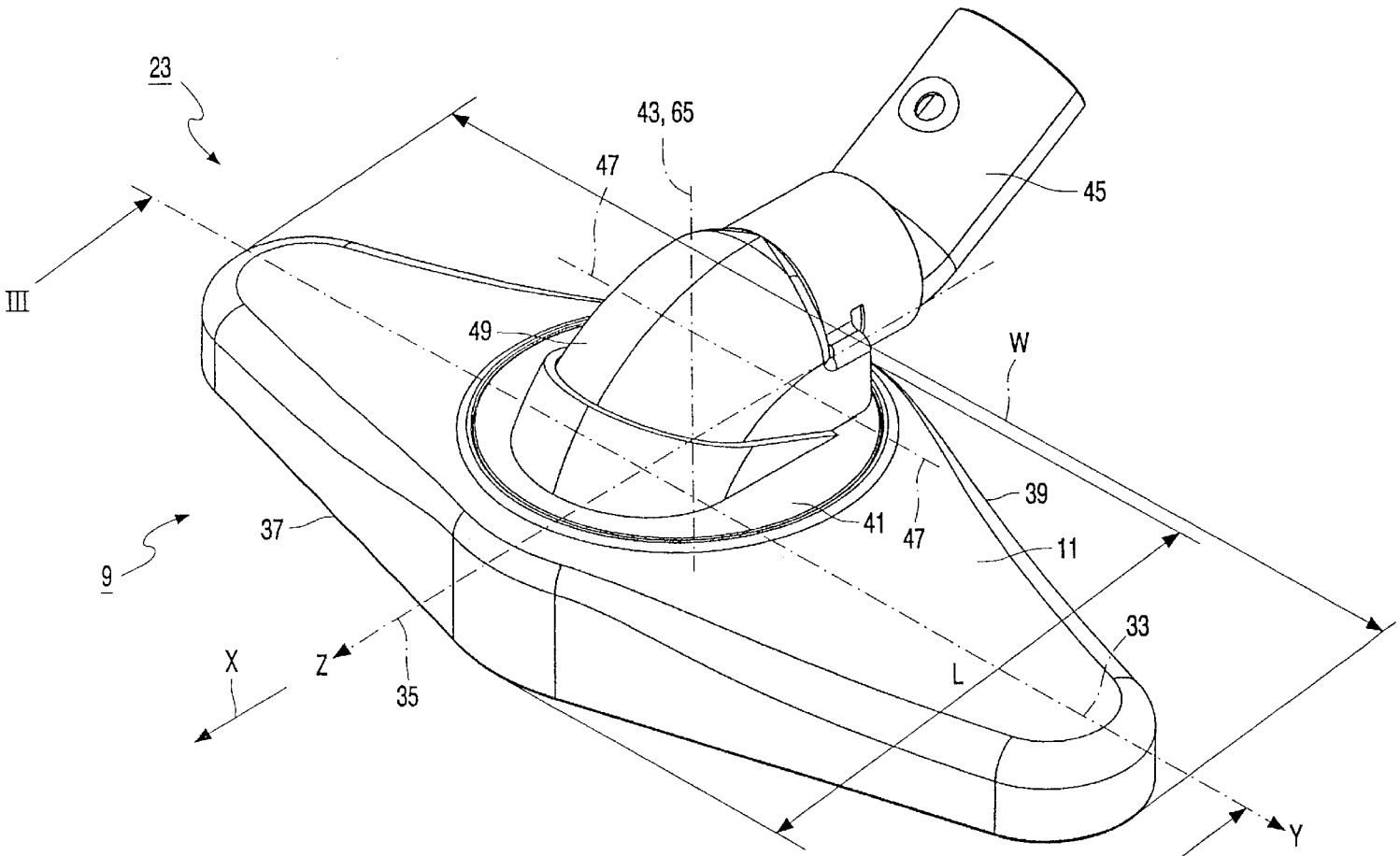
FIG. 2 shows a suction attachment in accordance with the invention, which is used in the vacuum cleaner shown in FIG. 1.
Figure 3:
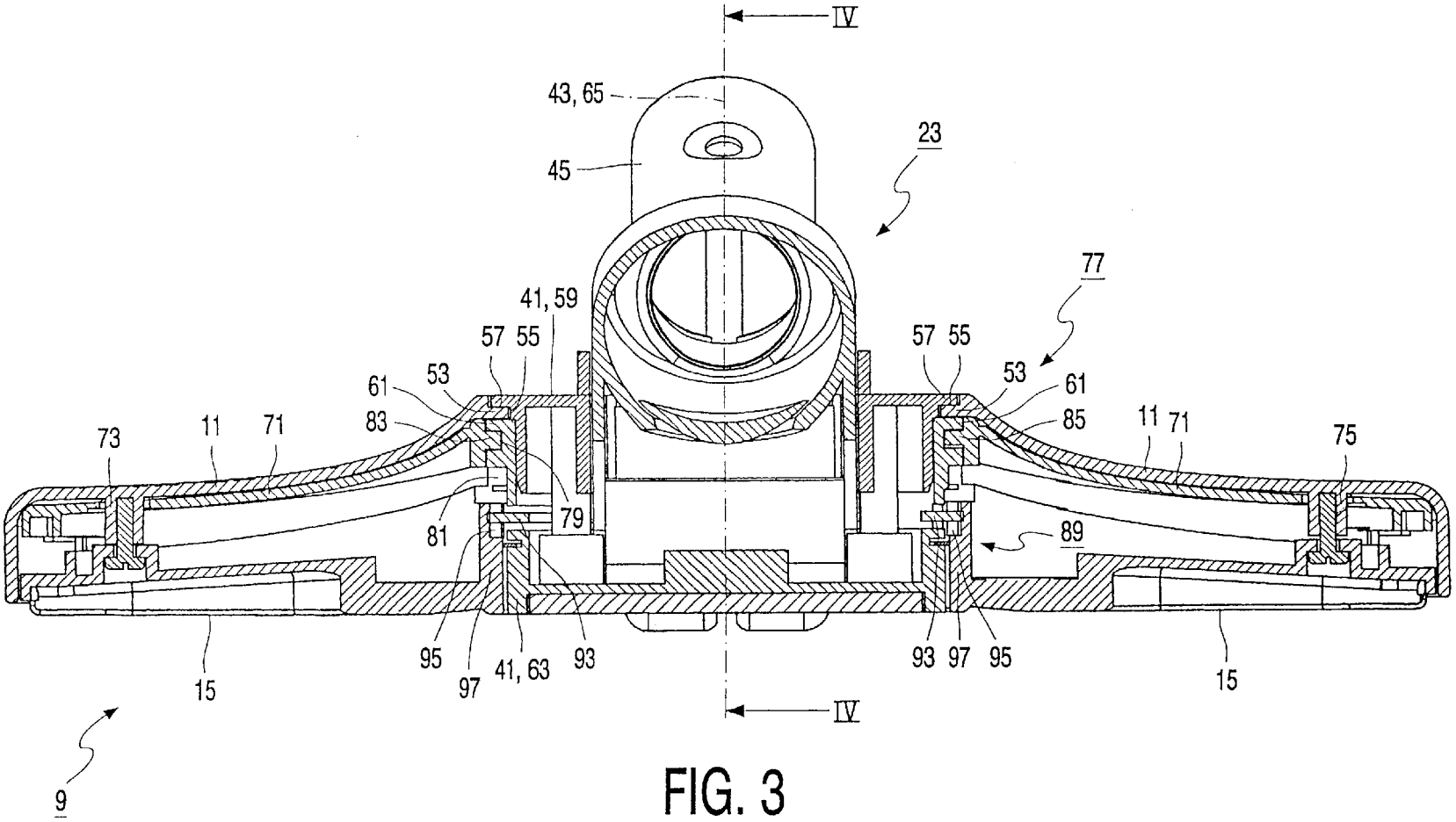
FIG. 3 is a sectional view of the suction attachment taken on the line III—III in FIG. 2.
Figure 4:
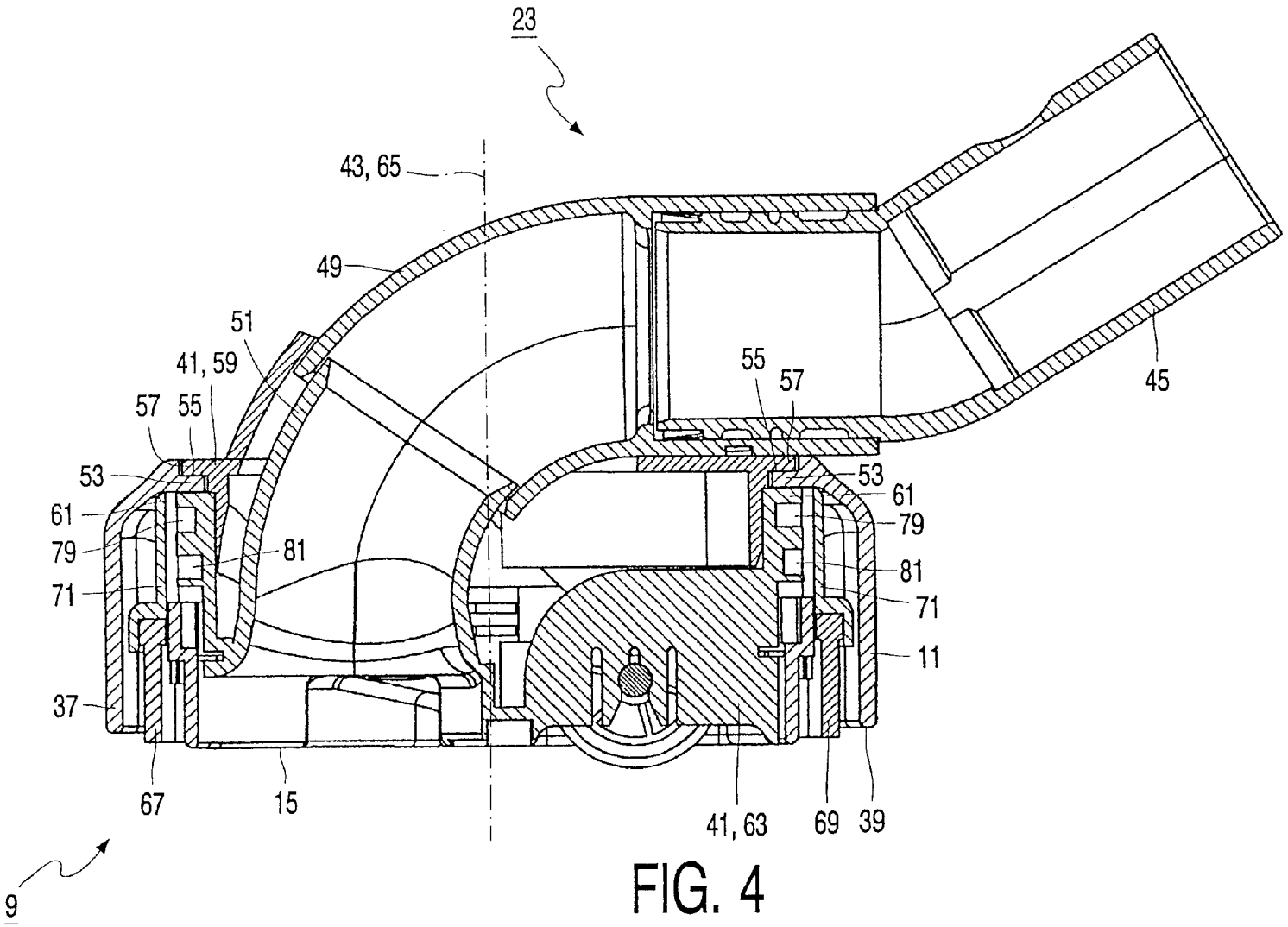
FIG. 4 is a sectional view of the suction attachment taken on the line IV—IV in FIG. 3.

The suction attachment 9 in accordance with the invention is shown in detail in FIGS. 2 through 4. As shown in FIG. 2, the foot 11 of the suction attachment 9 is substantially diamond-shaped, the foot 11 being substantially symmetrical with respect to a first axis 33, which extends in a width direction Y of the foot 11, and with respect to a second axis 35, which extends in a longitudinal direction Z of the foot 11. Viewed in the width direction Y, the foot 11 has a width W which is comparatively large with respect to a length L of the foot 11 seen in the longitudinal direction Z. FIG. 2 shows a first position of the foot 11 with respect to the connection member 23, in which position the foot 11, i.e. the first axis 33, extends substantially perpendicularly to a displacement direction X of the foot 11 over the surface 5 to be cleaned. The foot 11 further comprises a front edge 37 and a rear edge 39, which bound the suction opening 15 of the foot 11 and both extend, in the first position of the foot 11 shown in FIG. 2, transversely to the displacement direction X.

Figure 5:
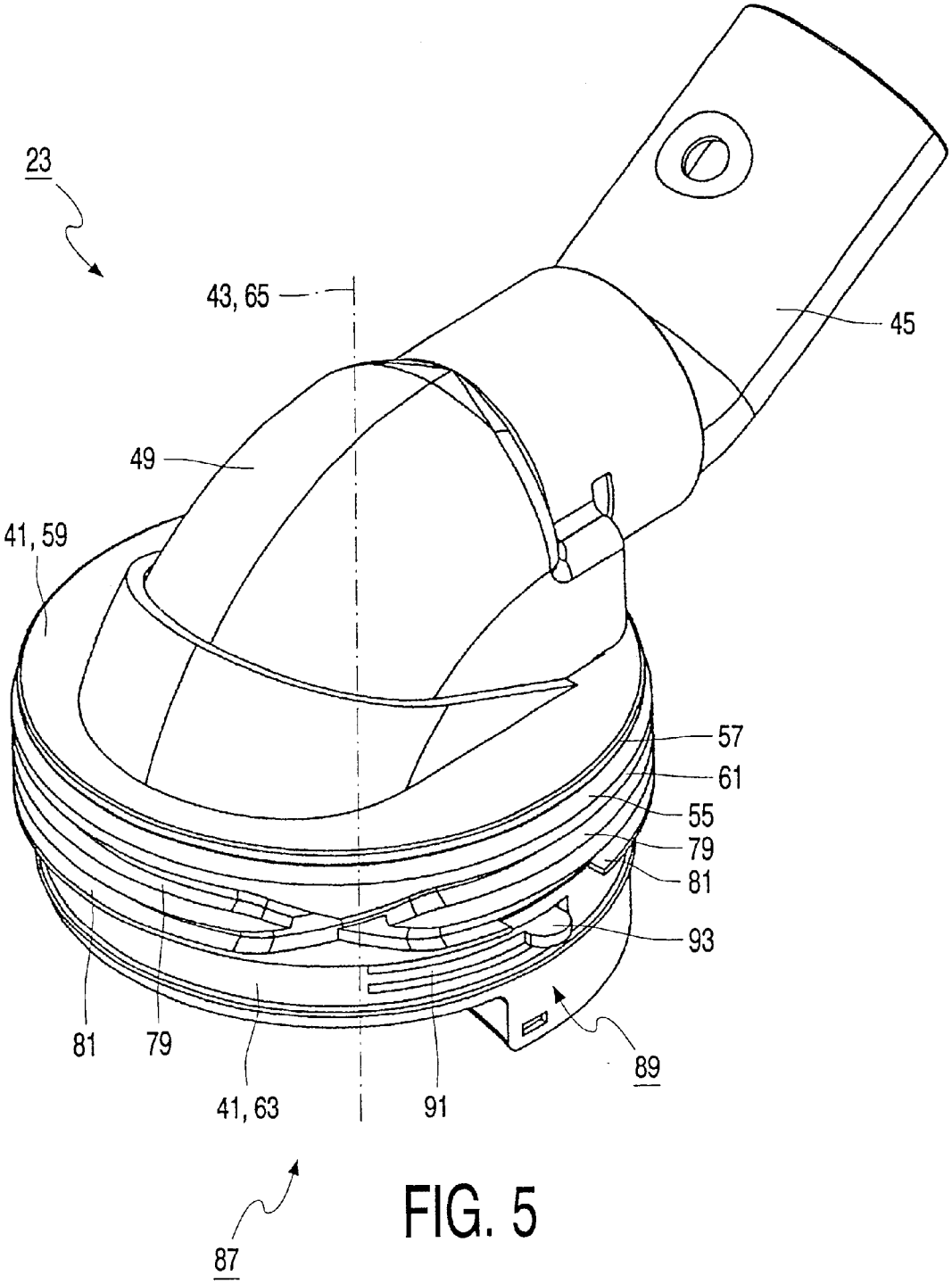
FIG. 5 shows a connection member of the suction attachment shown in FIG. 2, and FIGS. 6*a* through 6*d* diagrammatically show a foot of the suction attachment shown in FIG. 2 in four different positions with respect to the connection member.

The connection member 23 of the suction attachment 9 is shown in detail in FIG. 5 and is provided with a substantially cylindrical portion 41 having a central axis 43 extending substantially perpendicularly to the imaginary plane 13 of the suction opening 15. The connection member 23 is further provided with a connection channel 45, which can be coupled to and detached from the suction tube 19 of the vacuum cleaner. The connection channel 45 is pivotable, with respect to the cylindrical portion 41 and the foot 11, about a pivot axis 47, as shown in FIG. 2, which extends substantially perpendicularly to the central axis 43 and substantially parallel to the width direction Y of the foot 11. As shown in FIG. 4, the connection channel 45 comprises, for this purpose, a bend 49 which telescopes when the connection channel 45 pivots about a further bend 51 of the cylindrical portion 41. The foot is mounted so as to be pivotable about the cylindrical portion 41 of the connection member 23. As shown in FIGS. 3 and 4, the foot 11 is provided, for this purpose, with a ring-shaped guiding means 53 which engages in a ring-shaped slot 55 in the cylindrical portion 41. The ring-shaped slot 55, which is also shown in FIG. 5, is situated between a flange 57 of an upper part 59 of the cylindrical portion 41 and a flange 61 of a lower part 63 of the cylindrical portion 41, which lower part is attached to the upper part. As the foot 11 is mounted so as to be rotatable about the cylindrical portion 41, the foot 11 is rotatable, with respect to the connection member 23, about an axis of rotation 65 extending substantially perpendicularly to the imaginary plane 13 of the suction opening 15 and substantially coinciding with the central axis 43 of the cylindrical portion 41, from the first position shown in FIG. 2 to a number of further positions which will be described in greater detail hereinbelow.

As shown in FIG. 4, the foot 11 is provided with a first brush 67, which is arranged near the front edge 37 of the foot 11, and a second brush 69, which is arranged near the rear edge 39 of the foot 11. The brushes 67 and 69 extend along, respectively, the front edge 37 and the rear edge 39 over substantially the entire width W of the foot 11. The brushes 67, 69 are provided on a common support 71, which is shown in FIGS. 3 and 4 and which, with respect to the foot 11, is displaceably guided in a vertical direction parallel to the axis of rotation 65 along two guide bushings 73, 75 provided in the foot 11. The support 71 forms part of a coupling member 77 shown in FIG. 3, by means of which the brushes 67, 69 are coupled to the connection member 23. The coupling member 77 is further provided with two substantially ring-shaped slots 79, 81, which are provided in an outer wall of the cylindrical portion 41 and are partly shown in FIG. 5, and two cam-shaped slot followers 83, 85 which are diametrically provided with respect to the axis of rotation 65 on the support 71 and engage in one of the slots 79, 81. As shown in FIG. 5, the slots 79, 81 extend in two parallel imaginary planes which extend substantially perpendicularly to the axis of rotation 65, said slots 79, 81 being interconnected crosswise at two diametrically opposite locations 87. It is to be noted that, in FIG. 5, only one of the two locations 87 is visible. In the first position of the foot 11 with respect to the connection member 23, as shown in FIG. 3, the slot followers 83, 85 are each situated in the uppermost slot 79, so that the support 71 and the brushes 67, 69 are held in a first position with respect to the foot 11 by the coupling member 77, in which first position, the brushes 67, 69 are recessed in the suction opening 15. If a user of the vacuum cleaner manually rotates the foot 11 about the axis of rotation 65 from its first position shown in FIGS. 2 through 4, then the slot followers 83, 85 simultaneously pass said two locations 87, as a result of which the slot followers 83, 85 are guided from the uppermost slot 79 to the lowermost slot 81. As a result, the support 71 and the brushes 67, 69 are displaced with respect to the foot 11 by the coupling member 77 in a direction substantially parallel to the axis of rotation 65 from their first position to a second position, wherein the brushes 67, 69 protrude from the suction opening 15. In this manner, the coupling member 77 in combination with the rotatable foot 11 jointly form an adjusting device of the suction attachment 9 in accordance with the invention, by means of which the brushes 67, 69 can be displaced from their first position to their second position and from their second position to their first position. In the first position of the brushes 67, 69, wherein the brushes 67, 69 are recessed in the suction opening 15, the suction attachment 9 is suitable for cleaning carpets, while in the second position of the brushes 67, 69, wherein the brushes protrude from the suction opening 15, the suction attachment 9 is suitable for cleaning smooth and/or hard surfaces. In order to rotate the foot 11 about the axis of rotation 65 and hence displace the support 71 and the brushes 67, 69 in the foot 11, the user must exert a torque on the foot 11 about the axis of rotation 65. As the foot 11 has comparatively large dimensions, the force to be exerted by the user on the foot 11 to achieve said torque is comparatively small, so that operating the adjusting device of the suction attachment 9 in accordance with the invention requires very little effort. By virtue thereof, the ease of use of the suction attachment 9 in accordance with the invention is improved substantially. As the axis of rotation 65 extends substantially perpendicularly to the imaginary plane 13 of the suction opening 15, the suction opening 15 is substantially not moved outside the imaginary plane 13 during the rotation of the foot 11 about the axis of rotation 65. In this manner, it is achieved that the operating position of the suction attachment 9 on the surface 5 to be cleaned, in particular the position of the connection member 23 with respect to the surface 5 to be cleaned, remains substantially unchanged when the foot 11 is rotated, which also has a favorable effect on the ease of use of the suction attachment 9 in accordance with the invention.

Figure 6A:
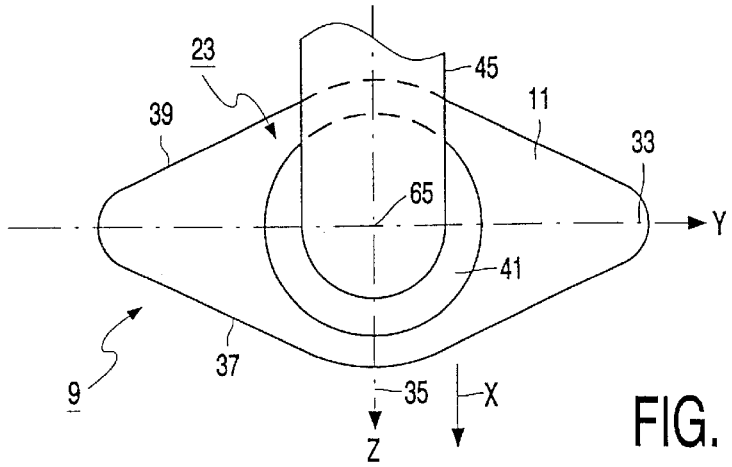
Figure 6B:
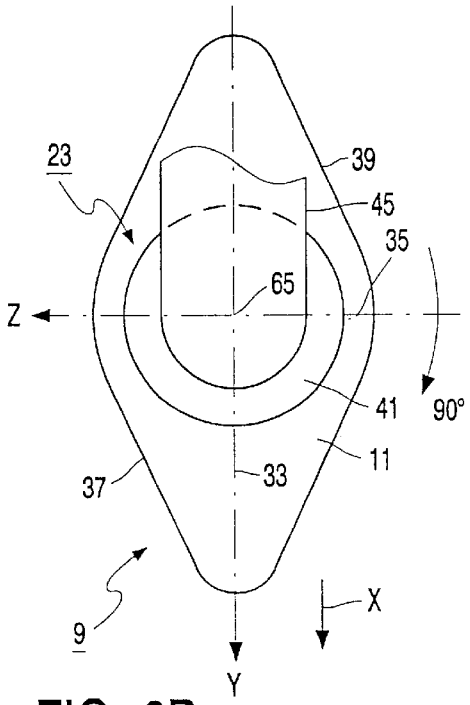
Figure 6D:
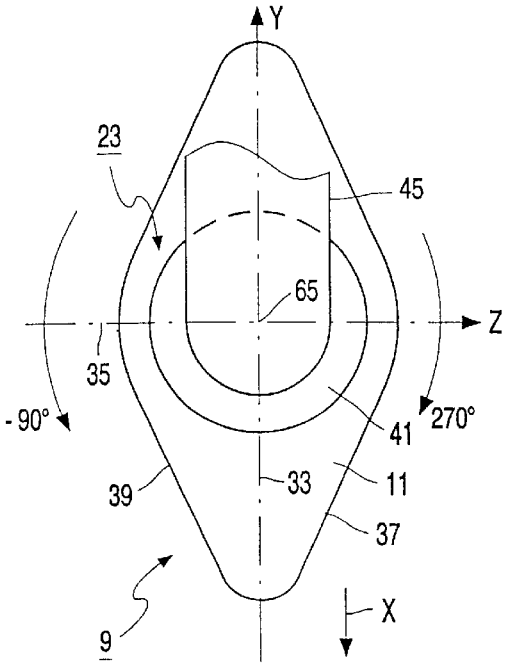
Figure 6C:
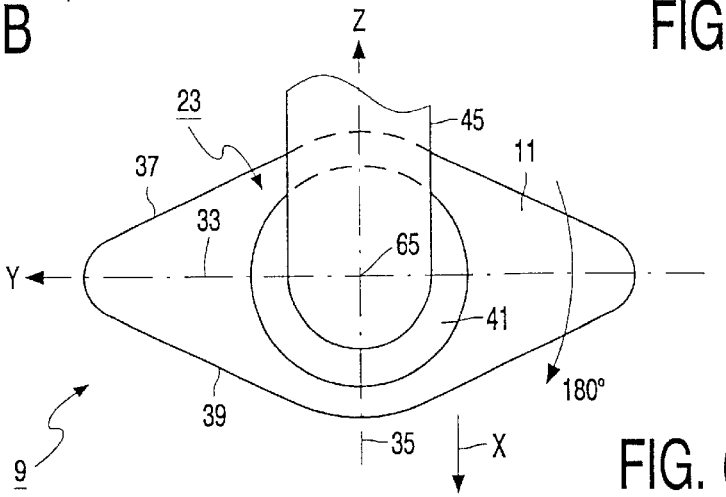

FIGS. **6*b*–6*d* diagrammatically show a number of positions of the foot 11 with respect to the connection member 23, to which positions the foot 11 can be rotated about the axis of rotation 65 from its first position described hereinabove and shown in FIG. 6*a*. The foot 11 is rotatable from its first position to a second position shown in FIG. 6*c*, wherein the foot has been rotated about the axis of rotation 65 through an angle of substantially 180° with respect to its first position. As can be derived from FIGS. 3 and 5, the slot followers 83, 85 pass the locations 87 after a rotation of the foot 11 through an angle of approximately 45° from the first position of the foot 11, so that in the second position of the foot 11 as shown in FIG. 6*c*, the brushes 67, 69 are in their second position. From its first position, the foot 11 can also be rotated to a third position shown in FIG. 6*b*, wherein the foot 11 is rotated about the axis of rotation through an angle of almost 90° with respect to its first position, and to a fourth position shown in FIG. 6*d*, wherein the foot 11 is rotated about the axis of rotation 65 through an angle of substantially 270° with respect to its first position. As the slot followers 83, 85 pass the locations 87 after a rotation of the foot 11 through an angle of approximately 45° from the first position of the foot 11, the brushes 67, 69 are also in their second position when the foot 11 is in the third position shown in FIG. 6***b*. When the foot 11 is rotated from its second position shown in FIG. 6*c* to its fourth position shown in FIG. 6*d*, the slot followers 83, 85 again pass the locations 87, so that the brushes 67, 69 are again in their first position when the foot 11 is in the fourth position. The same result is obtained in the case of a direct rotation of the foot 11, i.e. through an angle of −90° about the axis of rotation 65, from its first position shown in FIG. 6*a* to its fourth position shown in FIG. 6*d*, because, in this case, the slot followers 83, 85 do not pass the locations 87, so that the brushes 67, 69 remain in their first position. As the foot 11 is substantially symmetrical with respect to the first axis 33 and the second axis 35, the foot 11 takes up comparable positions, in the first and the second position shown in FIG. 6*a* and 6*c*, with respect to the displacement direction X and the surface to be cleaned, so that the foot 11 has substantially equal suction properties in the first and the second position and, viewed perpendicularly to the displacement direction X, has comparable, relatively wide suction ranges. For the same reason, the foot 11 also takes up comparable positions, in its third and fourth position shown in FIGS. 6*b* and 6*d*, with respect to the displacement direction X and the surface to be cleaned, so that in its third and fourth position, the foot 11 also has substantially equal suction properties and, viewed perpendicularly to the displacement direction X, has comparable, relatively narrow suction ranges. In the first and the second position of the foot 11, the suction attachment 9 in accordance with the invention is suitable for normal use, while, in the third and the fourth position of the foot 11, the suction attachment 9 is suitable for use in comparatively narrow spaces or in corners. In combination with both the comparatively wide suction range and the comparatively narrow suction range, the suction attachment 9 can be used both with and without protruding brushes 67, 69, i.e. on hard surfaces as well as carpet, by rotating the foot 11 from, respectively, its first position to its second position or conversely, and from its third position to its fourth position, or conversely. By virtue thereof, the suction attachment 9 in accordance with the invention has a comparatively large number of applications.

The suction attachment 9 is further provided with a lock device 89 by means of which the foot 11 can be locked with respect to the connection member 23 in any one of the positions shown in FIGS. 6*a*–6*d*. The lock device 89 comprises two elastic tongues 91 which are provided diametrically opposite each other in the outer wall of the cylindrical portion 41 of the connection member 23. One of the two tongues 91 is shown in FIG. 5. At their end portions, the tongues 91 are provided with a lock cam 93. In FIG. 3, both lock cams 93 are shown in section. As shown in FIG. 3, in the first and the second position of the foot 11, the lock cams 93 fall into two openings 95 which are provided diametrically opposite each other in a substantially circular-cylindrical wall 97 in the foot 11, which surrounds the cylindrical portion 41 of the connection member 23. In the third and the fourth position of the foot, the lock cams 93 fall into two comparable openings, which are not shown in the Figure. Upon rotating the foot 11 from each one of its four positions, the user experiences a slightly increased resistance due to the fact that the two lock cams 93 emerge from the relevant openings, thereby elastically deforming the two tongues 91. As a result, it is precluded that the foot 11 is unintentionally rotated from the relevant position under the influence of handling forces exerted during operation. The ease of use of the suction attachment 9 in accordance with the invention is further improved thereby.

The above-described vacuum cleaner in accordance with the invention is a cylinder vacuum cleaner. It is noted that the invention also includes other types of vacuum cleaners, such as, for example, so-called upright vacuum cleaners. In such an upright vacuum cleaner, the suction attachment is, for example, pivotably coupled to the housing, said housing being in a substantially upright position when the upright vacuum cleaner is in an operating position.

It is further noted that the invention also includes suction attachments allowing the foot to be rotated to a different number of positions or only through a limited angle. For example, the invention includes a suction attachment allowing the foot to be rotated only through an angle of 180° from a first position to a second position, the brush being in its first position when the foot is in the first position, and in the second position when the foot is in the second position. The invention also includes a suction attachment allowing the foot to be rotated through an angle below 180°, or even below 90°, from a first position to a second position. In such an embodiment, the foot is, for example, round, so that in each position it takes up a comparable operating position with respect to the surface to be cleaned.

What is claimed is:

1. A suction attachment for a vacuum cleaner, which suction attachment is provided with a foot, a suction opening extending in an imaginary plane in the foot, which suction opening is bounded by an edge of the foot, and a connection member for connecting the foot to a suction channel of the vacuum cleaner, the foot being provided, near the edge, with a brush, which can be displaced by means of an adjusting device from a first position, wherein the brush is recessed in the suction opening, to a second position, wherein the brush protrudes from said suction opening, characterized in that the foot is rotatable with respect to the connection member about an axis of rotation extending substantially perpendicularly to the suction opening, from a first position to at least a second position, and in that the adjusting device comprises a coupling member by means of which the brush is coupled to the connection member, the coupling member holding the brush in its first position when the foot is in the first position, and in its second position when the foot is in the second position.

2. A suction attachment as claimed in claim 1, characterized in that, in its first position, the foot extends substantially perpendicularly to a displacement direction of the foot while, in its second position, the foot is rotated about the axis of rotation through an angle of substancially 180° with respect to its first position.

3. A suction attachment as claimed in claim 2, characterized in that the foot is provided with a front edge and a rear edge extending transversely to the displacement direction, and, near the front edge and the rear edge, with a separate brush which can be displaced by means of the adjusting device.

4. A suction attachment as claimed in claim 2, characterized in that the foot can also be rotated about the axis of rotation to a third position, wherein the foot is rotated through an angle of substancially 90° with respect to its first position, and to a fourth position, wherein the foot is rotated through an angle of substancially 270° with respect to its first position, the coupling member holding the brush in its first position when the foot is in the third position, and in its second position when the foot is in the fourth position.

5. A suction attachment as claimed in claim 4, characterized in that the suction attachment is provided with a lock device by means of which the foot can be locked in at least one of its four positions with respect to the connection member.

6. A suction attachment as claimed in claim 1, characterized in that the connection member is provided with a substantially cylindrical portion having a central axis extending substantially perpendicularly to the suction opening, and with a connection channel which can be connected to the suction channel of the vacuum cleaner, the foot being journalled so as to be rotatable about the cylindrical portion, while the connection channel is pivotable, with respect to the cylindrical portion about a pivot axis extending substantially perpendicularly to the central axis.

7. A suction attachment as claimed in claim 1, characterized in that the connection member is provided with a substantially cylindrical portion having a central axis extending substantially perpendicularly to the suction opening, the foot being journalled so as to be rotatable about the cylindrical portion, while the coupling member is provided with a slot, which is provided in an outer wall of the cylindrical portion, a support for the brush, which support is guided in the foot so as to be displaceable in a direction substantially parallel to the central axis, and a slot follower, which is provided on the support and engages in the slot.

8. A vacuum cleaner provided with a housing, wherein an electrical suction unit is accommodated, and with a suction attachment which can be coupled to the suction unit via a suction channel and is provided with a foot, a suction opening in the foot extending in an imaginary plane, which suction opening is bounded by an edge of the foot, and a connection member for connecting the foot to the suction channel, the foot being provided, near the edge, with a brush, which can be displaced, by means of an adjusting device, from a first position, wherein the brush is recessed in the suction opening, to a second position, wherein the brush protrudes from the suction opening, characterized in that the suction attachment is a suction attachment as claimed in claim 1, 2, 3, 4, 5, 6 or 7.

* * * * *